United States Patent [19]

Morse

[11] 4,093,117

[45] June 6, 1978

[54] MAILER

[76] Inventor: Henry Clifton Morse, 345 Fullerton Pkwy., Chicago, Ill. 60614

[21] Appl. No.: 691,853

[22] Filed: Jun. 1, 1976

[51] Int. Cl.[2] ..... B65D 27/00

[52] U.S. Cl. ..... 229/70; 35/75; 229/92.1

[58] Field of Search ..... 35/31 E, 75; 229/68 R, 229/70, 92.1, 92.3

[56] References Cited

U.S. PATENT DOCUMENTS

| | | | |
|---|---|---|---|
| 2,603,410 | 7/1952 | True et al. | 229/92.1 |
| 3,334,806 | 8/1967 | Hiersteiner | 229/70 |
| 3,902,656 | 9/1975 | Rothchild | 229/68 R X |
| 3,968,927 | 7/1976 | Katz | 229/70 |

*Primary Examiner*—Stephen P. Garbe
*Attorney, Agent, or Firm*—Hill, Gross, Simpson, Van Santen, Steadman, Chiara & Simpson

[57] ABSTRACT

A mailer formed from one piece of relatively stiff cardboard and including a mailing flap, detachable when the mailer reaches the addressee. The mailing flap extends over an open-ended envelope carrying a slide card, connected to the envelope by a tab, to hold the slide card to the envelope during passage through the mail. The slide card may carry a message or may be used in cooperation with the envelope as an informational advertising or educational device. The mailer is formed from four connected sections. Three of the sections are defined by folds and a fourth section is partially severed from the cardboard and its inner end is defined by a slit extending for substantially the length thereof. This section may carry a message or cooperate with educational information on the envelope and is folded between the first and second sections defining the envelope and retained thereto by the tab. The mailer has an adhesive strip extending along the inner side thereof for gluing the envelope into an open-ended envelope having the slide card carried thereon. Score lines enable the mailing flap to be severed from the envelope.

10 Claims, 6 Drawing Figures

MAILER

FIELD OF THE INVENTION

Mailing envelope of the type generally found in Class 229/70.

PRIOR ART

The Patents to Meyer U.S. Pat. No. 2,467,299; Hiersteiner U.S. Pat. No. 3,302,861 and Liber U.S. Pat. No. 2,544,844 show several forms of mailing envelopes and also show a case for microfilm. These patents were cited in a prior abandoned joint application filed by me and Ronald H. Taub on Nov. 20, 1968, Ser. No. 777,361. This application was directed to a display card for razor blades and was abandoned, not because met by the prior art, but because the display card was not put into commercial use. The structure of the abandoned application, however, is considerably different from the disclosure of the present application.

Computer slide cards in which a slide card is slidable along an open-ended envelope and serves to cooperate with openings in the envelope to designate educational and other interesting information are further known and such devices have been made by applicant for promotional purposes.

SUMMARY AND ADVANTAGES OF INVENTION

The device of the present invention differs from the prior art devices of which applicant is aware in that it is primarily a mailer envelope and slide card having a mailing flap extending over one side of an open-ended envelope, having the slide card in the envelope, and attached thereto by a tab integral with the slide card and envelope. The tab may be broken when access to the slide card is desired, by exerting force on the slide card through thumb notches in the envelope. The slide card may carry a message, advertising material or indicia which may cooperate with openings in at least one of the sides of the envelope to designate educational or other information, on the slide rule principle.

The entire envelope, mailer and slide card are made from one piece of cardboard stiff enough to withstand the rough usage of mail handling without deformation and to meet with the approval of the Postal Department. The mailing flap may serve to glue the two sides of the envelope together to form an envelope for the slide card and the adhesive line may terminate at a longitudinally scored portion of the mailing flap, to enable removal of the mailing flap when the mailer reaches the addressee. The mailer also may be transversely scored on the inside with score marks, to enable coupons printed on the inside of the mailing flap to be torn from the mailing flap.

The advantages of the present invention are that one piece of stiff cardboard may be formed by machine into an open-ended envelope capable of withstanding the rough usage of the Postal Service with a detachable mailing flap formed from the same piece of cardboard and extending over the envelope with a slide on the inside of the envelope formed from the same piece of cardboard.

A further advantage of the invention is that a one-piece, open-ended envelope with a detachable mailing flap and a slide within the envelope as formed and detachably attached thereto by a breakable tab formed integrally with the envelope and slide, may carry a message or cooperate with the envelope, to give educational information without stuffing the envelope, and is sufficiently stiff to pass through the mails as first, third or bulk mail with Post Office Department approval.

A still further advantage of the invention is that the mailer forms a rigid mailer, formed from one piece of stiff cardboard in which a slide card is held to the mailer by a tab formed integrally with the mailer during the forming operation thereof and is breakable to accommodate the removal of the slide card from the envelope.

A still further advantage of the invention is that the mailer forms a one-piece mailer and informational device conforming to Post Office standards for first class, third class individual or bulk mailing in which it is unnecessary to stuff the envelope as the mailer is completed.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure.

DESCRIPTION OF THE PREFERRED EMBODIMENT

Figure 1:
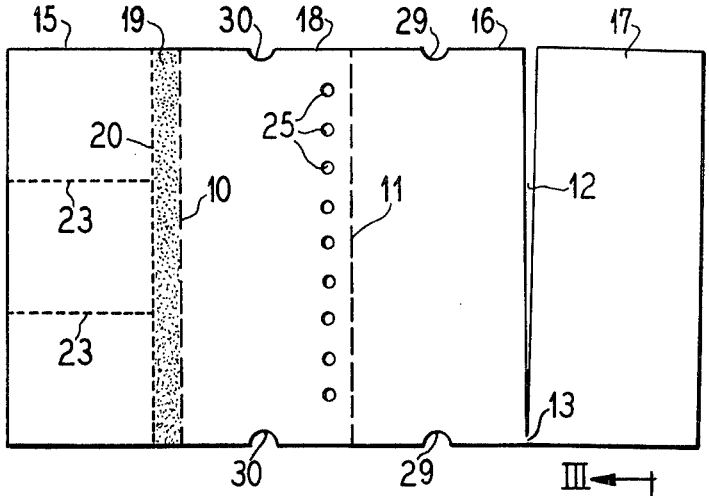
FIG. 1 is a view of a stiff cardboard sheet from which the envelope, mailing flap and slide are formed.

In the embodiment of the invention illustrated in the drawings, I have shown in FIG. 1 a flat, stiff cardboard sheet divided into four substantially equal sections, three sections of which are defined by folds 10 and 11 and a fourth section of which is defined by a slit 12 extending for substantially the length thereof and terminating short of the end of the piece of cardboard, to form a tab 13 which may retain the slide card to the envelope. A first section 15 will hereinafter be termed a mailing flap and is adapted to be folded or bent over a third section forming a front 16 of the envelope and adapted to have a fourth section forming a slide card 17 folded thereover with the tab 13 intact. The front section and slide card are adapted to be folded over a second section forming a back 18 of the envelope with the slide between the front and back sections.

The front and back sections and flap are usually printed prior to the forming operation, and where the slide card and envelope are to be used as a slide rule type of device to give educational information, the back, or front and back, are suitably perforated prior to the forming of the envelope, slide and mailing flap, as will hereinafter more clearly appear as this specification proceeds.

Figure 2:
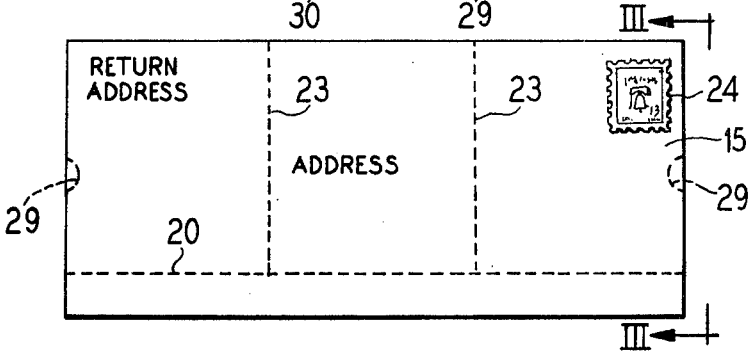
FIG. 2 is a plan view of the completed mailer ready for mailing.
Figure 3:
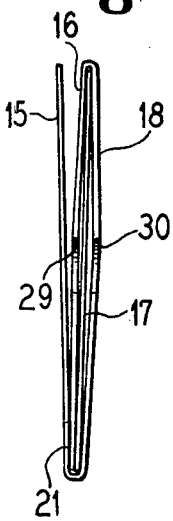
FIG. 3 is an end view taken substantially along line III—III of FIG. 2.

The mailing flap 15 has an adhesive strip 19 defining its inner margin and also has score lines 20 extending along the outer margin of the adhesive strip. The adhesive strip may also be applied prior to forming and after printing. The score lines are preferably made before forming. The portion of the mailing flap 15 extending along the adhesive strip may thus form an adhesive flap 21, gluing or adhesively securing the front 16 to the back 18, when bent along the edge or fold 11 over the back section 18, to form an open envelope with the mailing flap or first section 15 extending over the front section, as shown in FIGS. 2 and 3. Prior to bending the section 16 about the bend line 11 over the section 18, the slide card 17 is slit as indicated by reference numeral 12 and then bent inwardly along the section 16 about the tab 13 to form a message or information bearing slide card, accessible when the mailer reaches its destination and the tab 13 is broken by sliding the slide card along the envelope by grasping either end of the card through open-ended thumb notches 29 and 30 in the front and back sections 16 and 18, respectively. The mailing flap 15 may also be transversely scored preferably from the inside by score lines 23, not as deep as the score lines 20, so as not to deface the outside of the mailer. Coupons or other desired material may then be printed on the back of the mailing flap 15 prior to bending in place, to be detached by the addressee when the mailer reaches its destination.

The mailing flap is shown in FIG. 2 as having a stamp 24 thereon, as the leading corner of the mailing flap and the side thereof opposite the score lines 20. A return address may be printed on the opposite end of the mailer from the stamp and the address of the addressee may be typed, printed or otherwise placed on the mailing flap by any conventional means. This is usually done when the mailer is in its completed form, but may be done prior to forming, if desired.

When the mailer reaches its destination, the mailing flap 15 may be separated along the score lines 20 and the coupons, where transverse score lines and coupons are provided, may be separated along the transverse score lines 23. The slide card 17 with its message or indicia is safely encased in the envelope with no liability of losing the slide card in the mails, unless it should be deliberately removed by breaking the tab 13.

Figure 4:
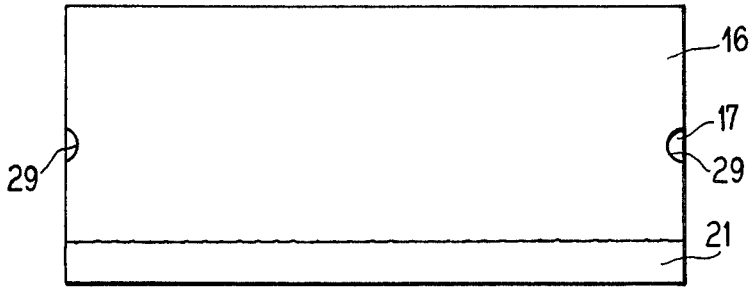
FIG. 4 is a view of the open-ended envelope with the mailing flap removed.
Figure 5:
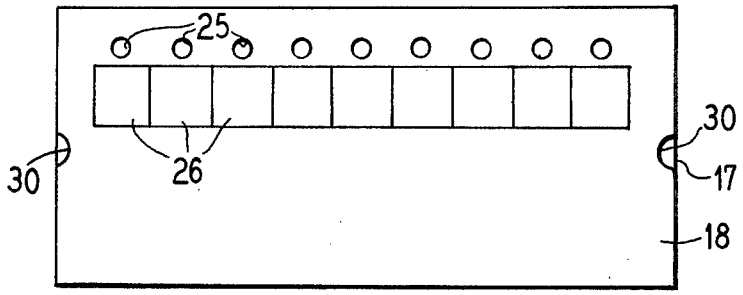
FIG. 5 is a back view of the mailer, looking at the opposite side of the mailer from FIG. 2.
Figure 6:
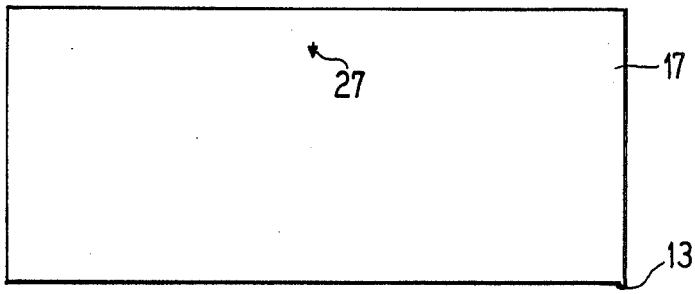
FIG. 6 is a plan view of the slide and illustrating the torn tab, upon detachment of the slide from the envelope.

In FIG. 4, I have shown the front face of the envelope with the slide therein, while in FIG. 5, I have shown a back face of the envelope having round apertured portions 25 spaced therealong opposite indicia, which may be printed in squares 26 spaced along the back face. The apertured portions 25 are formed prior to forming of the envelope, as previously mentioned, and are so arranged as not to be caught in mechanical mailing equipment and to cooperate with a pointer 27 on the slide card 17, which may also be printed on said slide prior to forming. Other information or indicia may be printed on the slide card prior to forming and be exposed as the pointer registers an apertured portion 25. The slide card and back face of the envelope may thus be of a slide-rule type of information device, which is known to the art and is not a part of the present invention so need not be described further.

The front of the envelope may also have spaced openings therein (not shown), opposite suitable indicia, and cooperating with a pointer on the slide card, if desired.

I do not, however, desire to be limited to an envelope of the "slide-rule" type, since in many cases, the mailer may include simply an envelope and detachable slide card having a message printed thereon and sealed or retained to the envelope by the breakable tab 13.

It will be understood that in forming the mailer, a sheet of relatively rigid cardboard is formed, as shown in FIG. 1, and the adhesive strip 19 is applied to the inside of the first section or mailing flap 15 prior to folding and after printing. The slide card 17 being slit after printing may then be bent over the front of the envelope 16 and the slide card 17 and front of the envelope may be bent along the bend line 11 to engage the slide card 17 with the back 18.

Adhesive being applied along the strip 19, and the mailing flap 15 being scored along the score lines 20 and 23, may then be bent along the bend line 10, into engagement with the front of the envelope 16 and adhesive being applied along the adhesive strip 19 may adhesively secure the open envelope into its closed form, with the mailing flap 15 extending along the front of said envelope. The mailing flap 15 being stamped and addressed, the mailer may be placed in the mail either as first class, third class or third class bulk mail and is capable of passing Postal regulations, and has been approved by the Post Office Department as acceptable in the mail at the third class or third class bulk rate. The slide card 17 being retained to the envelope by the tab 13, may, therefore, carry a message and safely be mailed as first or third class mail.

When the mailer reaches its destination, the addresses may sever the mailing flap from the envelope along the score lines 20 and sever the coupons along the score lines 23, where coupons are printed on the back of the mailing flap 15. Access to the slide card 17 may then be attained through the thumb notches 29 and 30.

I claim as my invention:

1. For use as a mailer and communications device, a one-piece stiff cardboard strip having parallel end edges extending from the length thereof and side edges connecting said end edges together and including four connected sections, three defined by fold lines, and a fourth defined by a slit extending for substantially the length of the fourth section, a first section having an inner and an outer side and forming a mailing flap and having an adhesive strip extending along said inner side one of said fold line defining an inner side edge of said first section, a second section comprising a back for the mailer, a third section comprising a front for the mailer and folded over the back, and glued to the mailing flap by the adhesive strip, and a fourth section comprising a slide connected with the third section by a tab and folded over the third section and slide relative to the envelope as the mailer is in its completed form as said tab is broken by a pushing or pulling action on the slide, when the mailer reaches its destination, and forming a communication carrying device.

2. The mailer of claim 1, wherein the stiff cardboard is of a stock of the order of 10 to 12 point and is preprinted prior to forming.

3. The mailer of claim 2, wherein apertured portions are spaced along the back, in registry with educational indicia on said back, and the slide card cooperates with said apertured portions to indicate educational information.

4. The mailer of claim 3, wherein the mailing flap has score lines extending along the edge of the adhesive strip opposite the fold line and accommodating ready removal of said mailing flap from the envelope after the mailer has reached its destination.

5. A one-piece mailer comprising a relatively heavy cardboard mailing flap having an outer side edge and an inner side edge, an adhesive strip extending along the inner side edge of said mailing flap, score lines defining the outer side edge of said adhesive strip, an envelope open at its ends and including a back bent from said mailing flap along the inner side edge of said adhesive strip, a front bent from said back to extend over said back and protected when passing through the mail by said mailing flap, said mailing flap and said front being secured together by said adhesive strip.

a slide card slit from said front for substantially the length thereof and carried inside of the mailer, and a tab connecting said slide card to said front and breakable by the addressee as the envelope reaches its addressee, to supply communicational information.

6. The mailer of claim 5, wherein the mailing flap is detachable along the score lines defining the outer side edge of the glue strip, upon arrival of the mailer at its addressee.

7. The mailer of claim 6, wherein the mailing flap is transversely scored and has coupons printed thereon prior to forming, and removable by the addressee along the transversely scored portions thereof.

8. The mailer of claim 7, wherein the cardboard is of a stock in the order of between 10 and 12 point stock and is preprinted prior to forming.

9. The mailer of claim 8, wherein the envelope has spaced apertured portions formed therein prior to forming of the envelope and cooperating with indicia thereon, and the slide card has indicia printed thereon prior to forming of the slide card and cooperating with said apertured portions upon slidable movement of said slide card relative to said envelope, to indicate educational information.

10. The mailer of claim 5, wherein the mailing flap, envelope and slide card are one integral piece, as the mailer reaches its destination.

* * * * *